US006926135B1

(12) United States Patent
Liebers

(10) Patent No.: US 6,926,135 B1
(45) Date of Patent: Aug. 9, 2005

(54) EYEGLASSES CASE WITH CLIP-ON GLASSES COMPARTMENT

(75) Inventor: Steven B. Liebers, Norristown, PA (US)

(73) Assignee: Diversified Products, Inc., Collegeville, PA (US)

( * ) Notice: Subject to any disclaimer, the term of this patent is extended or adjusted under 35 U.S.C. 154(b) by 37 days.

(21) Appl. No.: 10/361,664

(22) Filed: Feb. 10, 2003

(51) Int. Cl.[7] ..... A45C 11/04
(52) U.S. Cl. ..... 206/6; 150/131
(58) Field of Search ..... 150/117, 131, 143; 190/111, 112, 113, 114; 206/5, 5.1, 6

(56) References Cited

U.S. PATENT DOCUMENTS 1,427,947 A * 9/1922 Flitton ..... 206/5
1,995,664 A 3/1935 Boyes
2,294,794 A * 9/1942 Morelli ..... 190/111
2,730,152 A * 1/1956 Stakofsky ..... 150/116
2,851,076 A * 9/1958 Stakofsky ..... 150/116
2,877,779 A * 3/1959 Bromberg ..... 134/99.1
3,144,127 A 8/1964 Fogel
3,352,391 A * 11/1967 Vaughan ..... 190/111
3,825,110 A 7/1974 Halbich et al.
4,865,186 A 9/1989 Gates
D308,752 S 6/1990 Hall
4,938,326 A * 7/1990 Pfeiffer ..... 190/109
4,951,811 A 8/1990 Lines
4,960,208 A 10/1990 Tempke
5,016,749 A 5/1991 Kaye et al.
D351,945 S 11/1994 Kopel
D379,263 S 5/1997 Sussman
5,676,242 A 10/1997 Scott
5,706,935 A * 1/1998 Lorton ..... 206/38
5,915,545 A 6/1999 Shackel et al.
5,921,383 A 7/1999 Shefler
6,003,663 A 12/1999 Newcomer
6,164,452 A 12/2000 Ellis
D452,612 S 1/2002 Alexandroff

* cited by examiner

*Primary Examiner*—John A. Ricci
(74) *Attorney, Agent, or Firm*—Caesar, Rivise, Bernstein, Cohen & Pokotilow, Ltd.

(57) ABSTRACT

A combined eyeglasses and clip-on glasses case is provided which includes a base having a recess to hold the eyeglasses, a base cover hinged to the base by a hinge and having a clip-on glasses recess adapted to hold the clip-on glasses, and a clip-on glasses recess cover, hinged to the base cover by a second hinge. The base cover is rotatably attached by the base cover hinge to the base, wherein the base cover is movable from a closed position such that the base recess is covered, to an open position wherein the base recess is opened. The clip-on glasses recess cover is rotatably attached by the recess cover hinge to the base cover, wherein the clip-on glasses recess cover is movable from a closed position such that the clip-on glasses recess is covered to an open position wherein the clip-on glasses recess is opened.

8 Claims, 4 Drawing Sheets

10
18
26
12
2
2

EYEGLASSES CASE WITH CLIP-ON GLASSES COMPARTMENT

BACKGROUND OF THE INVENTION

1. Field of Invention

This invention relates to a case for eyeglasses, and, in particular, to a case for both eyeglasses and an associated pair of clip-on glasses.

2. Description of Related Art

Numerous cases and containers have been designed for storing eyeglasses and associated products, such as a second pair of glasses, contact lens cases, tools for repairing eyeglasses, and the like. For example, U.S. Design Pat. No. 308,752 (Hall) is a design patent that teaches a combined eyeglass case and utility pouch. This is a non-hinged, soft case style design and has a main compartment for holding eyeglasses and a second, utility compartment attached to an outer surface of the main compartment. Both compartments appear to be made from a soft, flexible material.

U.S. Design Pat. No. 351,945 (Kopel) is a design patent that teaches a combined eyeglass case and wallet. As in the Hall patent above, the design teaches a non-hinged, soft case style with a main compartment for holding eyeglasses and a second compartment useful as a wallet.

U.S. Design Pat. No. 379,263 (Sussman) is a design patent for a case for eyeglasses and contact lenses. This is a hinged design wherein a single main hinge covers a two part, bathtub-shaped, main compartment. The main compartment has a length (i.e., a longest dimension) that accommodates eyeglasses and a holder for a pair of contact lenses. The contact lens container holder is located at an end of a larger compartment that receives the pair of eyeglasses.

U.S. Design Pat. No. 452,612 (Alexandroff) teaches zippered, flexible eyeglass case for holding several pairs of eyeglasses as well as bottles and a mirror.

U.S. Pat. No. 1,995,664 (Boyes) is directed to a case for opthalmic mountings which contains two separate compartments. The case is constructed of flexible materials and contains a first compartment for holding a pair of eyeglasses and a second smaller compartment for holding an eyeglass chain.

U.S. Pat. No. 3,144,127 (Fogel) teaches a two-in-one eyeglass case. Here, the case is a flexible, zippered case that holds a pair of eyeglasses in each of two compartments. One zipper for each compartment provides access to that compartment.

U.S. Pat. No. 3,825,110 (Halbich et al.) is directed to a hinged, molded hard plastic case for eyeglasses. The halves have abutting perimetral edges and a latch to latch the halves together.

U.S. Pat. No. 4,865,186 (Gates) is directed to a case for eyeglasses and for contact lenses. The case is formed as a shell of rigid plastic with a cover and a base. The cover and base are hinged along a side edge. The case has a partition that is also hinged along the side edge. The partition forms the case into two compartments, one for holding eyeglasses and one for holding a contact lens case.

U.S. Pat. No. 4,951,811 (Lines) is directed to a combined eyeglass case, contact lens case and accessories case. The soft case is foldable from open to closed positions and is for storing eyeglasses, a contact lens case, and wetting solution bottles. A mirror is provided on the interior of the case.

U.S. Pat. No. 4,960,208 (Tempke) is directed to an eyeglass case kit including a case with an overlying flap. Cleansing solution cooperates with a cleansing fabric cloth positioned in and formed integrally to a forward flap of the case.

U.S. Pat. No. 5,016,749 (Kaye et al.) teaches a device for simultaneously carrying eyeglasses and contact lenses which includes a hollow open base for containing the eyeglasses. The base further contains a contact lense case secured to an interior surface of the base. A lid is hinged to the base for covering the opening and supports an optional mirror. The case is of a rigid hinged design.

U.S. Pat. No. 5,676,242 (Scott) is directed to a case for eyeglasses and sunglasses. The case has two separate, but connected compartments. One compartment may be opened by a zipper, while the other compartment may be opened by a foldover flap that snaps. This is a flexible style case.

U.S. Pat. No. 5,915,545 (Shackel et al.) is directed to a flexible style contact lens accessory kit that comprises two flaps connected by a soft hinge. An eyeglass holder is connected by a fastener to the outside of the kit.

U.S. Pat. No. 5,921,383 (Shefler et al.) is directed to a rigid type eyeglass case where two shell members are connected by a hinge. The two shell members each include an interior end portion provided with an internal receptacle for storage of miscellaneous accessory items such as nose pads, spare screws, a small screwdriver, etc.

U.S. Pat. No. 6,003,663 (Newcomer) discloses an eyeglass case that includes a rigid internal shell member surrounded by a flexible covering material provided with a flap to secure the case in a closed position. The shell member includes one or more internal receptacles for storage of miscellaneous accessory items, such as nose pads, spare screws, contact lenses, etc.

U.S. Pat. No. 6,164,452 (Ellis) is directed to a personal optical care container that includes a base portion and a removable lid portion. The portions are separable for quick access to the interior of the container. Eyeglasses, sunglasses, contact lenses and various other items are housed in the base portion. A strap is included for carrying the container.

None of these patents teaches and suggests a case for holding both eyeglasses and clip-on glasses.

All references cited herein are incorporated herein by reference in their entireties.

BRIEF SUMMARY OF THE INVENTION

A combined eyeglasses and clip-on glasses case is provided which includes a base having a recess to hold the eyeglasses and a base cover hinged to the base by a base cover hinge. The base cover has a clip-on glasses recess adapted to hold the clip-on glasses. The case further includes a clip-on glasses recess cover, hinged to the base cover by a clip-on glasses recess cover hinge. The base cover is rotatably attached by the base cover hinge to the base such that the base cover is movable from a closed position wherein the base recess is substantially covered to an open position wherein the base recess is substantially opened. The clip-on glasses recess cover is rotatably attached by the recess cover hinge to the base cover such that the clip-on glasses recess cover is movable from a closed position wherein the clip-on glasses recess is substantially covered to an open position wherein the clip-on glasses recess is substantially opened.

The use may include a mirror attached to the base cover. A hinged cover may be included to cover the mirror and provide protection for the glasses. Preferably, the case is constructed from generally rigid materials, for example, a polymeric material. Preferably, the recess in the base is lined with a material for padding the glasses. Additionally, preferably, the clip-on glasses recess is lined with a material for padding the clip-on glasses. A latch may be provided to secure the base cover to the base. Another latch may be provided to secure the clip-on glasses recess cover to the base cover. Finally, the base cover hinge and the clip-on glasses recess cover hinge are both preferably located along a back side of the base cover.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
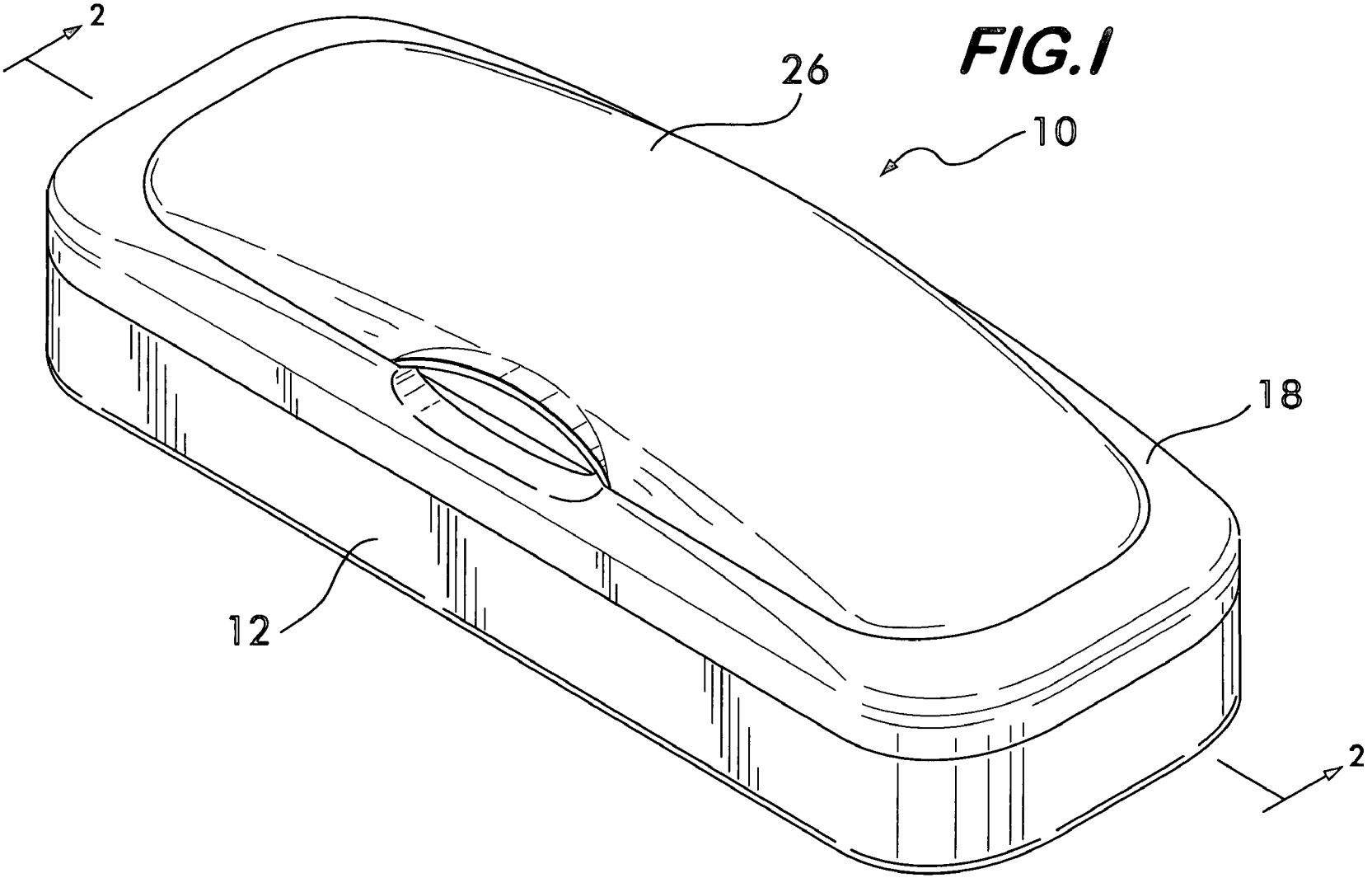
FIG. 1 is an isometric view of a combined eyeglasses and clip-on glasses case in accordance with one preferred embodiment of the present invention.

Referring now to the drawings, wherein like part numbers refer to like elements throughout the several views, there is shown in FIG. 1, a combined eyeglasses and clip-on glasses case 10 in accordance with one preferred embodiment of the present invention. The case 10 preferably includes a base 12 that has a bathtub-shaped recess 14 for holding a pair of eyeglasses 16. In a preferred embodiment, the eyeglasses 16 are preferably reading glasses, however, substantially any type of eyeglasses are considered to be within the scope of the present invention.

Figure 2:
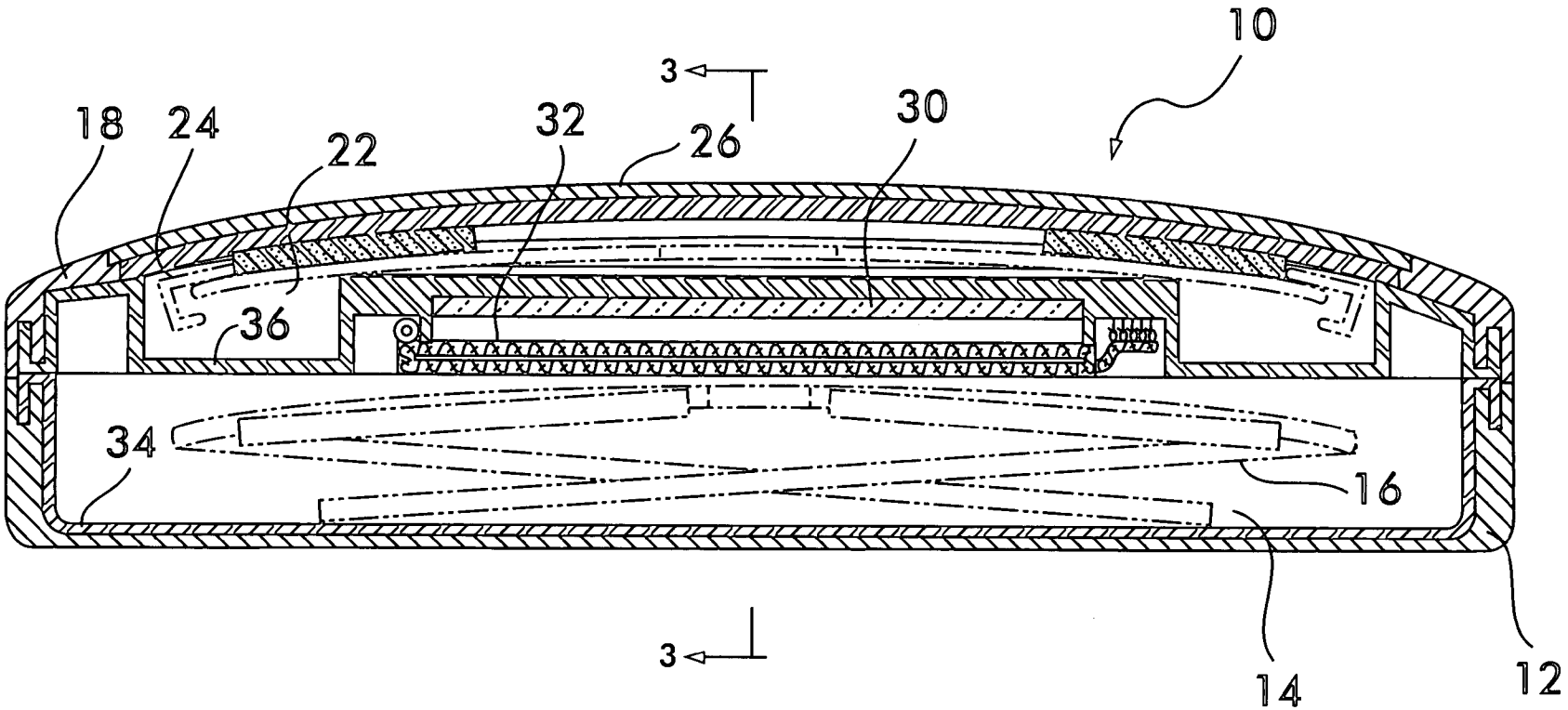
FIG. 2 is a cross-sectional, front elevational view of the combined eyeglass and clip-on glasses case of FIG. 1, taken substantially along lines 2—2 of FIG. 1.
Figure 3:
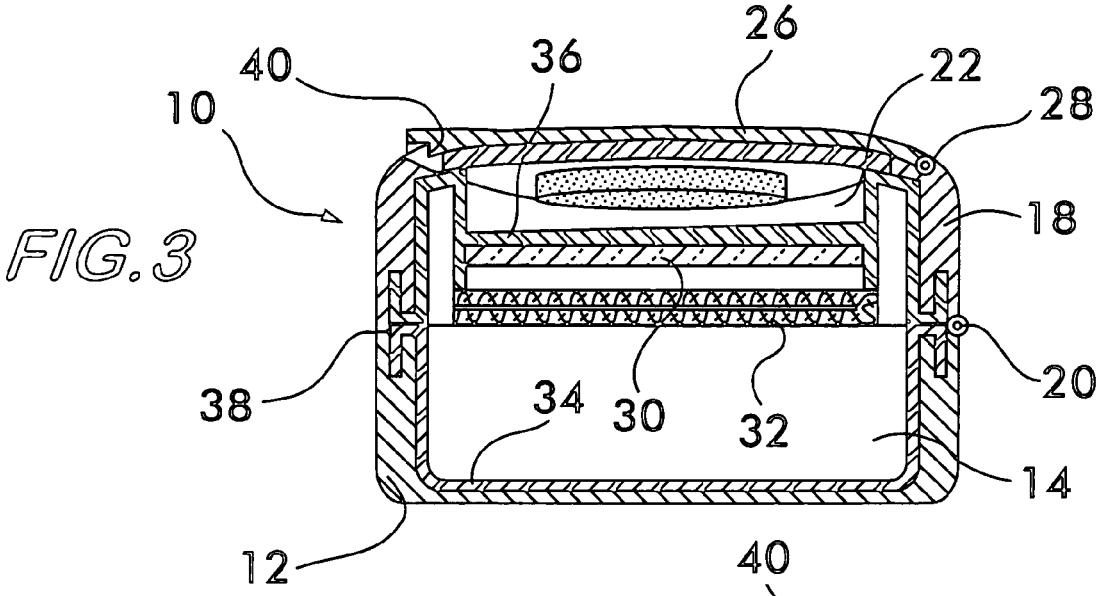
FIG. 3 is a cross-sectional, side elevational view of the combined eyeglasses and clip-on glasses case of FIG. 1, taken substantially along lines 3—3 of FIG. 2, shown with both a clip-on glasses recess cover in a closed position and a base cover in a closed position.
Figure 3A:
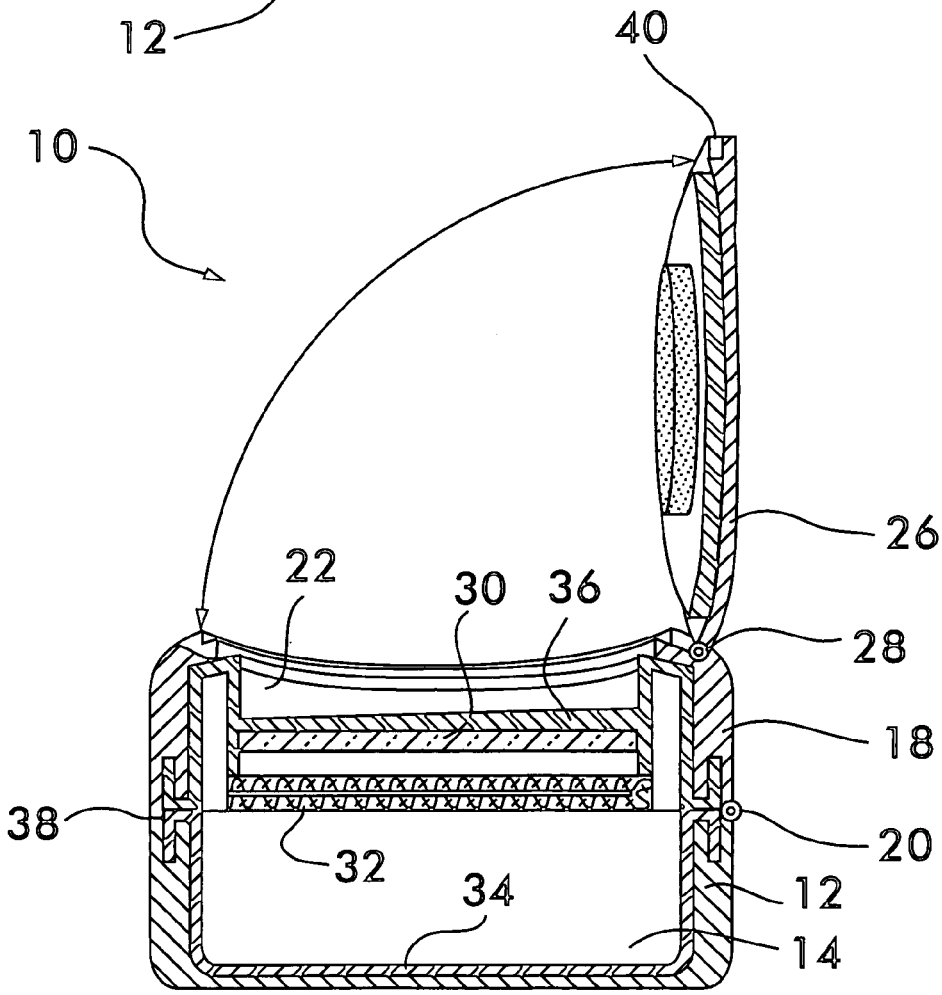
FIG. 3A is a cross-sectional, side elevational view of the combined eyeglasses and clip-on glasses case of FIG. 1, similar to FIG. 3, but shown with the clip-on glasses recess cover in an opened position.
Figure 3B:
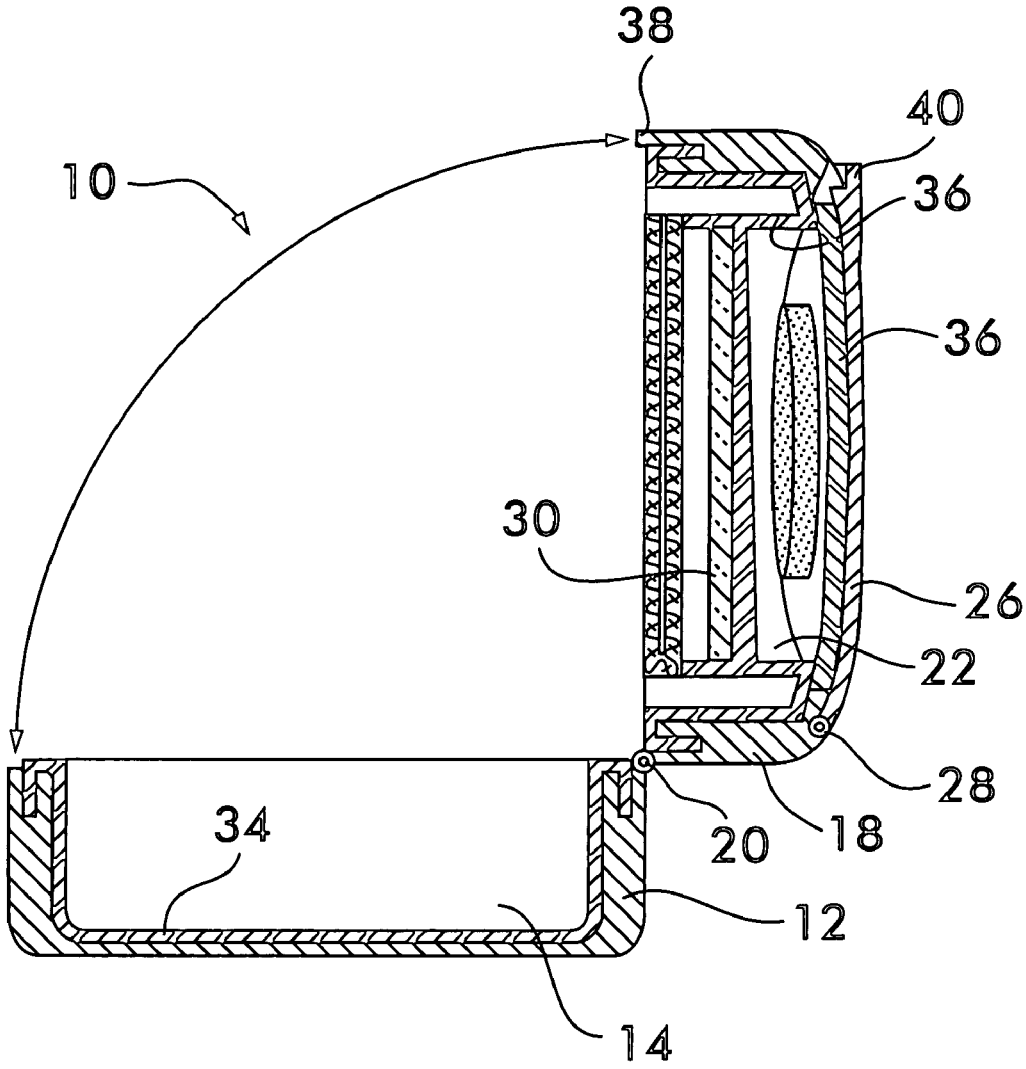
FIG. 3B is cross-sectional, side elevational view of the combined eyeglasses and clip-on glasses case of FIG. 1, similar to FIG. 3, but shown with the base cover in an opened position.

As can be seen in FIG. 2, the base 12 has a generally bathtub-shaped configuration. As best seen in FIGS. 3, 3A and 3B, a base cover 18 is hinged by a base cover hinge 20 to cover substantially the entire open top of the base recess 14. The base cover 18 includes a recess 22 sized to fit clip-on glasses 24 that are matable to the eyeglasses 16. The clip-on glasses recess 22 has a cover 26 that is hinged to the base cover 18 by a hinge 28. The clip-on glasses 24 may be, for example, sunglasses and/or have anti-reflective coatings for computer use.

As can be seen while looking at FIGS. 3, 3A and 3B together, the base cover 18 is rotatably attached by the base cover hinge 20 to the base 12. The base cover 18 is movable from a closed position (see FIG. 3) wherein the base recess 14 is substantially covered to an open position (see FIG. 3B) wherein the base recess 14 is opened to allow access for storage of the eyeglasses 16.

Similarly, the clip-on glasses recess cover 26 is rotatably attached by the clip-on glasses recess cover hinge 28 to the base cover 18, wherein the clip-on glasses recess cover 26 is movable from a closed position (see FIG. 3) wherein the clip-on glasses recess 22 is substantially covered to an open position (see FIG. 3A) wherein the clip-on glasses recess 22 is opened to allow access for storage of the clip-on glasses 24.

Optionally, the case may include a mirror 30 attached, for example, to the inside surface of the base cover 18. A hinged cover 32 may be provided to cover the mirror 30 and provide protection for the glasses from being scratched or otherwise damaged by the mirror.

Generally, it is desirable that the case 12, including the base 12, the base cover 18 and the clip-on glasses recess cover 26, be constructed from generally rigid materials, such as rigid polymeric materials, as are well known in the construction of eyeglasses cases. However, any known construction materials for eyeglass cases, such as covered sheet metal, would be equally applicable.

Preferably, the base recess 14 is lined with a soft material 34 for padding the glasses. Likewise, preferably, the clip-on glasses recess 22 is lined with a soft material 36 for padding the clip-on glasses.

A latch 38 may be provided to secure the base cover 18 to the base 12 and a separate latch 40 may be provided to secure the clip-on glasses recess cover 26 to the base cover 18. These latches may again be any known latches in the art of eyeglass cases, and for example, may be molded-in or may be in the form of springs in the hinges (not shown).

In alternate embodiments, the base cover hinge 20 may be positioned on any of the four sides of the base 12. Likewise, the clip-on glasses recess cover hinge 28 may be positioned on any of the four sides of the base cover. Additionally, the base cover hinge 20 and the clip-on glasses recess cover hinge 28 may be on the same access of rotation.

Although illustrated and described herein with reference to specific embodiments, the present invention nevertheless is not intended to be limited to the details shown. Rather, various modifications may be made in the details within the scope and range of equivalents of the claims without departing from the spirit of the invention.

What is claimed is:

1. A combined eyeglasses and clip-on glasses case, comprising:

(a) a base having a recess to hold the eyeglasses;

(b) a base cover, hinged to the base by a base cover hinge, having a clip-on glasses recess adapted to hold the clip-on glasses;

(c) a clip-on glasses recess cover, hinged to the base cover by a clip-on glasses recess cover hinge;

(d) the base cover rotatably attached by the base cover hinge to the base, wherein the base cover is movable from a closed position wherein the base recess is substantially covered to an open position wherein the base recess is substantially opened;

(e) the clip-on glasses recess cover is rotatably attached by the recess cover hinge to the base cover, wherein the clip-on glasses recess cover is movable from a closed position wherein the clip-on glasses recess is substantially covered to an open position wherein the clip-on glasses recess is substantially opened;

(f) a mirror attached to the base cover; and (e) a hinged cover to cover the mirror and provide protection for the glasses.

2. The combined eyeglasses and clip-on glasses case of claim 1, wherein the case is constructed from generally rigid materials.

3. The combined eyeglasses and clip-on glasses case of claim 1, wherein the case is constructed from generally rigid polymeric materials.

4. The combined eyeglasses and clip-on glasses case of claim 1, wherein the recess in the base is lined with a material for padding the glasses.

5. The combined eyeglasses and clip-on glasses case of claim 1, wherein the clip-on glasses recess is lined with a material for padding the clip-on glasses.

6. The combined eyeglasses and clip-on glasses case of claim 1, including a latch to secure the base cover to the base.

7. The combined eyeglasses and clip-on glasses case of claim 1, including a latch to secure the clip-on glasses recess cover to the base cover.

8. The combined eyeglasses and clip-on glasses case of claim 1, wherein the base cover hinge and the clip-on glasses recess cover hinge are located along a back side of the base cover.

* * * * *